US007556503B2

(12) United States Patent
Vinther

(10) Patent No.: US 7,556,503 B2
(45) Date of Patent: Jul. 7, 2009

(54) COMPLIANT ELECTRICAL CONTACT AND ASSEMBLY

(75) Inventor: Gordon A. Vinther, Hampton, NH (US)

(73) Assignee: Ardent Concepts, Inc., Hampton Beach, NH (US)

( * ) Notice: Subject to any disclaimer, the term of this patent is extended or adjusted under 35 U.S.C. 154(b) by 0 days.

(21) Appl. No.: 12/260,576

(22) Filed: Oct. 29, 2008

(65) Prior Publication Data

US 2009/0111289 A1 Apr. 30, 2009

Related U.S. Application Data

(60) Provisional application No. 60/983,545, filed on Oct. 29, 2007, provisional application No. 61/060,091, filed on Jun. 9, 2008.

(51) Int. Cl.
*H01R 13/05* (2006.01)

(52) U.S. Cl. ..... 439/66; 439/515

(58) Field of Classification Search ..... 439/66, 439/515, 71, 700, 824
See application file for complete search history.

(56) References Cited

U.S. PATENT DOCUMENTS

| | | | | |
|---|---|---|---|---|
| 3,372,308 | A | 3/1968 | Noschese et al. | |
| 4,161,346 | A | 7/1979 | Cherian et al. | |
| 4,199,209 | A | 4/1980 | Cherian et al. | |
| 4,362,353 | A * | 12/1982 | Cobaugh et al. | 439/825 |
| 4,370,017 | A * | 1/1983 | Grabbe et al. | 439/862 |
| 4,773,877 | A | 9/1988 | Krüger et al. | |
| 4,778,404 | A | 10/1988 | Pass | |
| 4,998,886 | A | 3/1991 | Werner | |
| 5,011,434 | A | 4/1991 | Blunt | |
| 5,167,512 | A | 12/1992 | Walkup | |
| 5,199,895 | A | 4/1993 | Chang | |
| 5,308,252 | A | 5/1994 | Mroczkowski et al. | |
| 5,667,410 | A | 9/1997 | Johnston | |
| 5,865,641 | A | 2/1999 | Swart et al. | |
| 5,984,693 | A * | 11/1999 | McHugh et al. | 439/66 |

(Continued)

FOREIGN PATENT DOCUMENTS

WO 92/08258 A1 5/1992

*Primary Examiner*—Gary F. Paumen
(74) *Attorney, Agent, or Firm*—Altman & Martin; Steven K. Martin

(57) ABSTRACT

A compliant electrical contact and an assembly employing a plurality of the contacts that provides an interface between two electrical devices. The contact has a convoluted spring with convolutions and a contact point at each end. In one contact embodiment, the convolutions have appendages which electrically short adjacent convolutions throughout a significant portion of the compression range of the contact. An appendage may be a single finger that extends from one convolution toward the adjacent convolution, a pair of opposed fingers that extend toward each other from adjacent convolutions, or machined edges on adjacent convolutions. In some configurations, the fingers or a surface on the appendage or fingers are at a skew angle to the direction of compression. In another contact embodiment, a shunt attached at one contact point and parallel to the spring spans most or all of the convolutions longitudinally. The shunt electrically shorts adjacent convolutions by wiping on the abutting surface of the shunt or by a wiper extending from the convolution to the shunt. Alternatively, the shunt electrically shorts the two contact points, bypassing the convolutions. The contact is placed within a through aperture in a dielectric panel that has openings at each end through which the contact points protrude.

19 Claims, 13 Drawing Sheets

U.S. PATENT DOCUMENTS 6,033,233 A * 3/2000 Haseyama et al. ..... 439/66
6,626,708 B2 * 9/2003 Phillips ..... 439/700

2007/0019422 A1 1/2007 Shau-din

* cited by examiner

COMPLIANT ELECTRICAL CONTACT AND ASSEMBLY

CROSS-REFERENCES TO RELATED APPLICATIONS

The applicant wishes to claim the benefit of U.S. Provisional Patent Application No. 60/983,545, filed Oct. 29, 2007 for COMPLIANT ELECTRICAL CONTACT AND ASSEMBLY in the name of Gordon A. Vinther, and of U.S. Provisional Patent Application No. 61/060,091, filed Jun. 9, 2008 for COMPLIANT ELECTRICAL CONTACT AND ASSEMBLY in the name of Gordon A. Vinther.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical contacts, more particularly, to very small compliant electrical contacts with low inductance at high frequencies.

2. Description of the Related Art

The purpose of an electrical contact is to provide a separable electrical interconnection between two electrical conductors. The characteristic of separability means that the conductors are not interconnected by permanent mechanical means, such as soldering or bonding, but by temporary mechanical means. Consequently, in order to maintain a good mechanical contact in an attempt to minimize detrimental electrical effects of the contact, some form of spring force is used to press the two conductors together. These electrical contacts are called compliant (as in "flexible") contacts.

Small compliant contacts are necessary for separably interconnecting integrated circuit (IC) devices to whatever electrical device the user desires. A prime example is connecting the IC to a test fixture or sorting equipment used for testing and sorting IC's during manufacture or an Original Equipment Manufacturer (OEM) type connector for connecting an IC to its operating environment such as a CPU in a personal computer, file server or mainframe computer. The compliant contact should be as close to electrically transparent as possible in order to minimize parasitic effects, such as inductance, that alter the signals to and from the IC which could lead to erroneous results.

Compliant contacts provide another advantage in that they can compensate for noncoplanarities of the devices (UUT's) being connected. The conduction points on the UUT's are not exactly coplanar, that is, they are not within the same plane, even between the same conduction point on different UUT's. The compliant contacts deflect by different amounts depending upon the actual position of the conduction point.

Conventional compliant contacts for connecting to UUT's include spring probes, conductive rubber, compliant beam contacts, and bunched up wire called fuzz buttons. Each technology provides the necessary means to overcome the noncoplanarities between the contact points and provides uniform electrical contact throughout a plurality of contacts.

Each technology has shortcomings in one characteristic or another and all have high electrical parasitic characteristics. In addition, they are relatively expensive to manufacture.

A typical spring probe consists of at least three or four parts, a hollow barrel with a spring and one or two plungers. The spring is housed in the barrel with the end of the plungers crimped in opposed open ends of the barrel at the ends of the spring. The spring biases the plungers outwardly, thereby providing a spring force to the tip of the plungers. Spring probes can have highly varying degrees of compliance and contact force, and are generally very reliable for making contact many times or for many cycles. Spring probes can accommodate many different conduction interfaces, such as pads, columns, balls, etc. Spring probes, however, have a size problem in that the spring itself cannot be made very small, otherwise consistent spring force from contact to contact cannot be maintained. Thus, spring probes are relatively large, leading to an unacceptably large inductance when used for electrical signals at higher frequencies. Additionally, spring probes are relatively costly since the three components must be manufactured separately and then assembled.

Conductive rubber contacts are made of rubber and silicones of varying types with embedded conductive metal elements. These contact solutions usually are less inductive than spring probes, but have less compliance and are capable of fewer duty cycles than spring probes. The conductive rubber works when the conduction point is elevated off the UUT thus requiring a protruding feature from the UUT or the addition of a third conductive element to the system to act as a protruding member. This third member lessens the contact area for a given contact force and thus increases the force per unit area so that consistent contact can be made. The third element may be a screw machined button which rests on the rubber between the conduction point. This third element can only add inductance to the contact system.

Compliant beam contacts are made of a conductive material formed such that deflection and contact force is attained at one end to the UUT conduction point while the other end remains fixed to the other conductor. In other words, the force is provided by one or more electrically conductive leaf springs. These contacts vary greatly in shape and application. Some compliant beam contacts are small enough to be used effectively with IC's. Some compliant beam contacts use another compliant material, such as rubber, to add to the compliance or contact force to the beam contact point. These later types tend to be smaller than traditional compliant beam contacts and thus have less inductance and are better suited for sorting higher frequency devices.

Fuzz buttons are a relatively old yet simple technology in which a wire is crumpled into a cylindrical shape. The resulting shape looks very much like tiny cylinder made of steel wool. When the cylinder is placed within a hole in a sheet of nonconductive material, it acts like a spring that is continuously electrically shorted. It provides a less inductive electrical path than other contact technologies. Like rubber contacts, the fuzz button is most commonly used with a third element needed to reach inside the hole of the nonconductive sheet to make contact with the fuzz button. This third element increases parasitic inductance, degrading the signals to and from the UUT.

IC packaging technology is evolving toward being smaller, higher frequency (faster), and cheaper, resulting in new requirements for these types of electrical contacts. They need to perform adequately at the lowest cost.

BRIEF SUMMARY OF THE INVENTION

An object of the present invention is to provide a compliant contact with a lower self-inductance at higher frequencies than existing technologies.

Another object is to provide a low-self-inductance contact and assembly that provide sufficient compliance to connect various electrical devices.

Yet another object is to provide a low-self-inductance contact and assembly that can be made extremely small for testing electrical devices with close conduction points.

A further object is to provide a low-self-inductance contact and assembly that are relatively inexpensive to manufacture.

The present invention is a compliant electrical contact and an assembly employing a plurality of the contacts that provides an interface between two electrical devices. The assembly is sandwiched between the electrical devices by a compression force in a direction of compression.

The contact has two basic embodiments. All configurations include a convoluted spring with convolutions. There is a contact point at each end of the spring that can come in many different configurations known in the art. Compression of the contact pushes the contact points against the electrical device conduction points. The compliance of the convolutions provide the feature of adjusting for the noncoplanarities of the conduction points.

In the first contact embodiment, the convolutions have appendages which electrically short adjacent convolutions throughout a significant portion of the compression range of the contact. An appendage may be a single finger that extends from one convolution toward the adjacent convolution, a pair of opposed fingers that extend toward each other from adjacent convolutions, or machined edges on adjacent convolutions. The appendages may be on alternate, opposite sides of the convolutions or all on one side of the convolutions. If the appendages short on alternate, opposite sides of the convolutions, at least one of the contact points may be forced through a twisting motion as it is compressed that can cut through potentially non-conductive oxides on the surface of the conduction point.

In some configurations, the fingers or a surface on the appendage or fingers are at a skew angle to the direction of compression. For example, the opposed fingers are bent in the opposite directions, are separated by an angled slot or beveled to prevent them from binding on each other and directing them to one side or the other of each other during compression. The magnitude of the skew angle depends on the particular application. The smaller the skew angle, the smaller the force necessary to compress the contact, which means that the contact will provide a smaller force against the conduction points. As the skew angle approaches 90°, that is, perpendicular to the direction of compression, the contact will not compress further once the appendage has come into contact with the adjacent convolution. As the angle approaches 0°, the contact pressure between an appendage and the adjacent convolution is small and may not maintain the electrical short. As the skew angle approaches 0°, the finger(s) must be offset from each other or the adjacent convolution so that they do not bind on each other during compression.

For most of the contact configurations, the appendages are nearly always shorting adjacent convolutions throughout the compression range. For other configurations, the appendage is not shorted to the adjacent convolution until the contact has been compressed some distance. In all of the contact configurations of the first embodiment, adjacent convolutions are shorted throughout a significant portion of the compression range.

In the second embodiment of the contact of the present invention, the contact has a shunt attached at one contact point that is parallel to the spring and spans most or all of the convolutions longitudinally, leaving a length that the shunt does not span. The length leaves space for the contact to fully compress. In some configurations, the shunt electrically shorts adjacent convolutions by wiping on the abutting surface of the shunt. In other configurations, each convolution is electrically shorted to the shunt by a wiper. In other configurations, the shunt electrically shorts the two contact points, bypassing the convolutions.

The contact is used in an assembly that provides temporary electrical connections to conduction points between the two electrical devices. In general, the contact is placed within a through aperture in a dielectric panel that has openings at each end through which the contact points protrude. Adjacent contacts can be oriented at right angles to each other, parallel to each other, or any other angle deemed desirable for a particular application. Optionally, the space within the apertures remaining after the contact is installed is filled with a compliant, electrically conductive elastomer. The contact is secured in the aperture by any adequate means.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
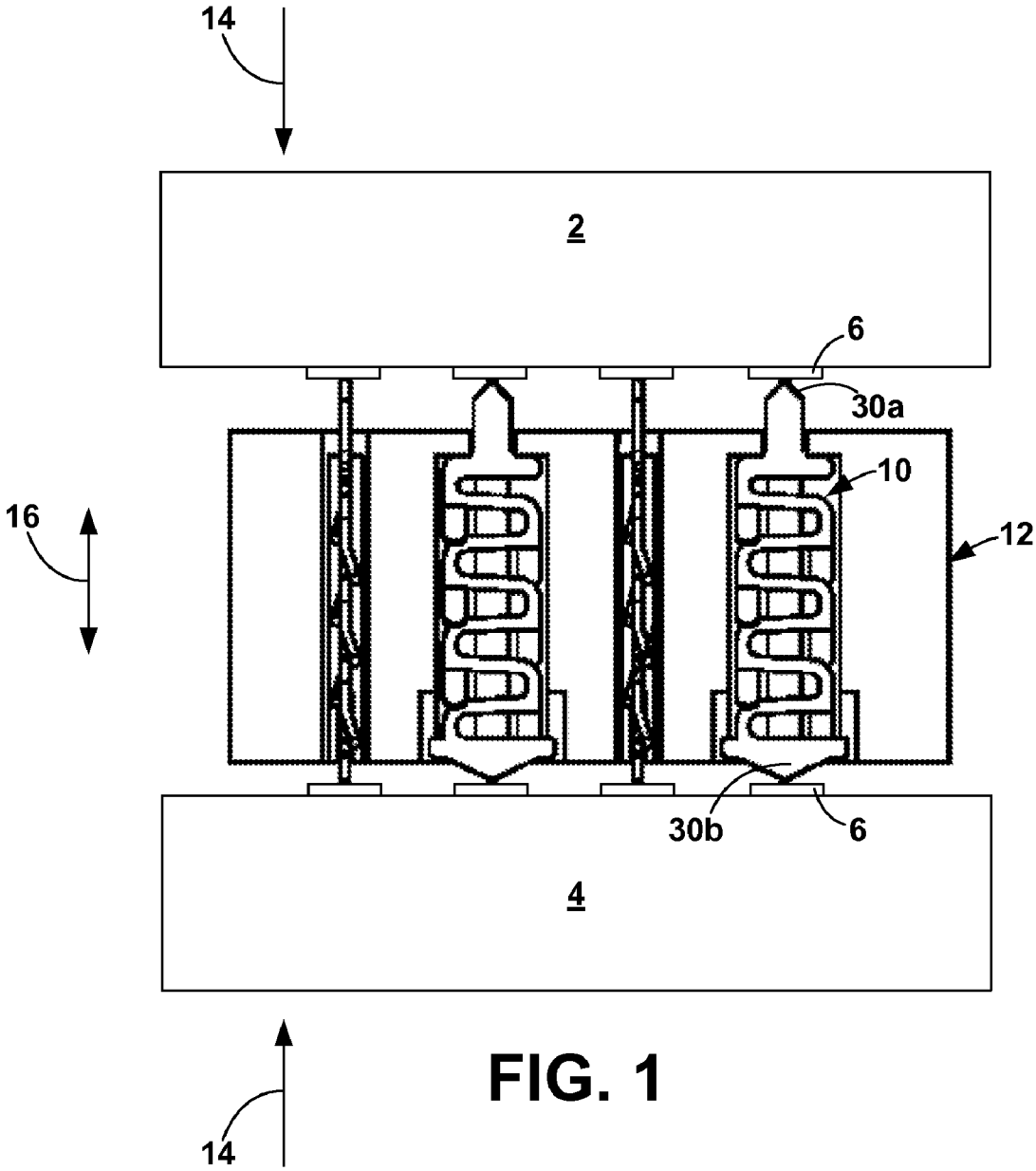
FIG. 1 is a side, cross-sectional view of an assembly of the present invention between two electrical devices.

The present invention is a compliant electrical contact 10 with low self-inductance and an assembly 12 employing a plurality of the contacts 10 that provides an interface between two electrical devices 2, 4, typically an integrated circuit (IC) and a printed circuit board (PCB) or pair of PCBs. As shown in FIG. 1, the assembly 12 with the contacts 10 is sandwiched between the electrical devices 2, 4 by a compression force 14 in a direction of compression 16. The compression force 14 may come from one direction only or from opposite directions simultaneously. The mechanism that produces the compression force may not compress the electrical devices 2, 4 and assembly 12 together linearly; they may be compressed through an arc where there are both horizontal and vertical components to the compression. The direction of compression 16 is the component of the compression that pressed the electrical devices 2, 4 and assembly 12 together. In FIG. 1, that direction is vertical. As a consequence of the compression, the contacts 10 are also compressed generally longitudinally. Since each contact 10 is not always perfectly aligned with the direction of compression 16, the longitudinal axis 28 of the contact 10 may be at some small angle to the direction of compression and the contact 10 may be compressed within that small angle, that is, generally parallel to the direction of compression 16.

The contact 10 of the present invention has two basic embodiments, each with a number of configurations. All configurations include a convoluted spring 20 with a longitudinal axis 28 and convolutions 22. The convolutions 22 can have a constant length and cross-section or the convolutions 22 can have a length that varies and/or a cross-section that varies as, for example, in a further flattened or flat pyramidal shaped cross-section.

The contact 10 has two contact points 30*a*, 30*b* (collectively, 30), one at each end, that make electrical contact with the conduction points 6 of the electrical devices 2, 4. The contact points 30 may come in many different end configurations known in the art. For example, most of the figures show contact points 30 that are the rounded corner of a single thickness of material. Another example is a rolled over forged end that is two thicknesses of material. In another example, the contact point 30 is a solder ball which can be permanently fixed to a PCB, thus ensuring a quality electrical connection to the PCB. The present invention contemplates any end configuration that is adequate for the desired application.

As described above, the contact 10 provides a temporary electrical connection between the conduction points 6 of two electrical devices 2, 4. In order to provide a good electrical connection, the contact 10 is compressed by application of the compression force 14 so that the spring force of the contact 10 pushes the contact points 30 of the contact 10 against the electrical device conduction points 6. The compliance of the convolutions 22 provide the necessary feature of adjusting for the noncoplanarities of the conduction points 6 of the electrical devices.

Figure 19:
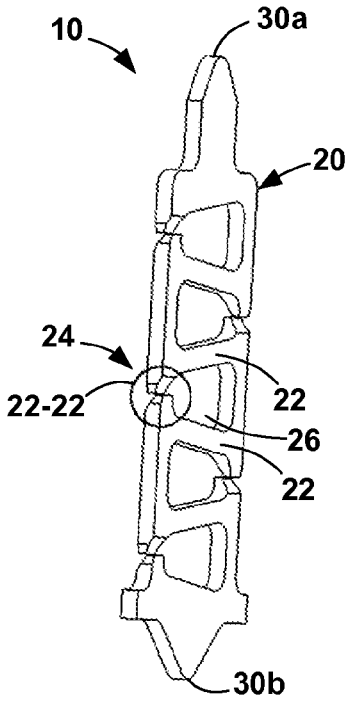
FIG. 19 is an isometric view of a configuration of the appendage embodiment of the contact of the present invention where separation in the opposed fingers has opposing angles peened into the material.
Figure 20:
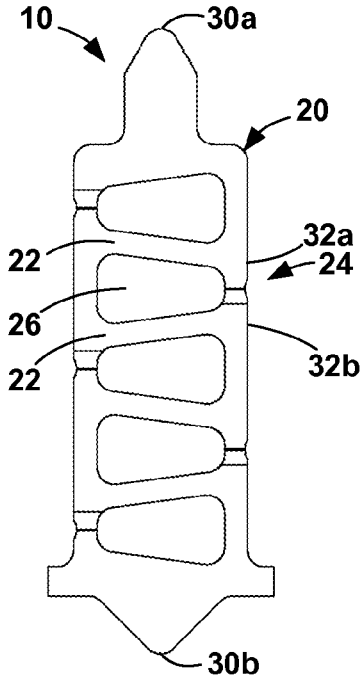
FIG. 20 is a front view of the contact of FIG. 19.
Figure 21:
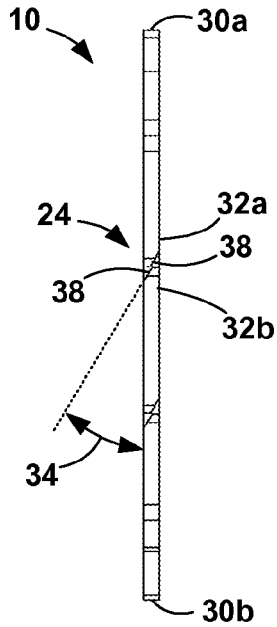
FIG. 21 is a side view of the contact of FIG. 19.
Figure 22:
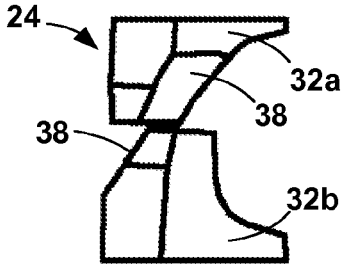
FIG. 22 is a detail view of area 22-22 of the contact of FIG. 19.

In the first embodiment of the contact of the present invention, the convolutions 22 have appendages 24 which electrically short a convolution 22 to the adjacent convolution 22 throughout at least a significant portion of the compression range of the contact 10, as described below. The appendage 24 may be a distinct component of the convolution 22, that is, it is a portion of the convolution 22 that has no other purpose than to contact the adjacent convolution 22. Such an appendage 24 may be a single finger 32, as in the configuration of FIGS. 2 and 9, or it may consist of a pair of opposed fingers 32*a*, 32*b*, as in the configuration of FIGS. 13, 16, and 19. Alternatively, the appendage 24 may be a portion of the convolution 22 that is indistinct, that is, the appendage function is not its only function, as in the configuration of FIG. 24.

The gap 26 between convolutions 22 can be any size. The greater the length of the appendage 24, the greater the gap 26 may be, the stipulation being that the appendage 24 must close the gap 26 and create an electrical short prior to or at some point during the compression range of the contact 10, as described below. The present invention also contemplates that the gap 26 may get larger and smaller throughout the length of the gap 26, that is, the gap 26 may not have a constant width.

Figure 9:
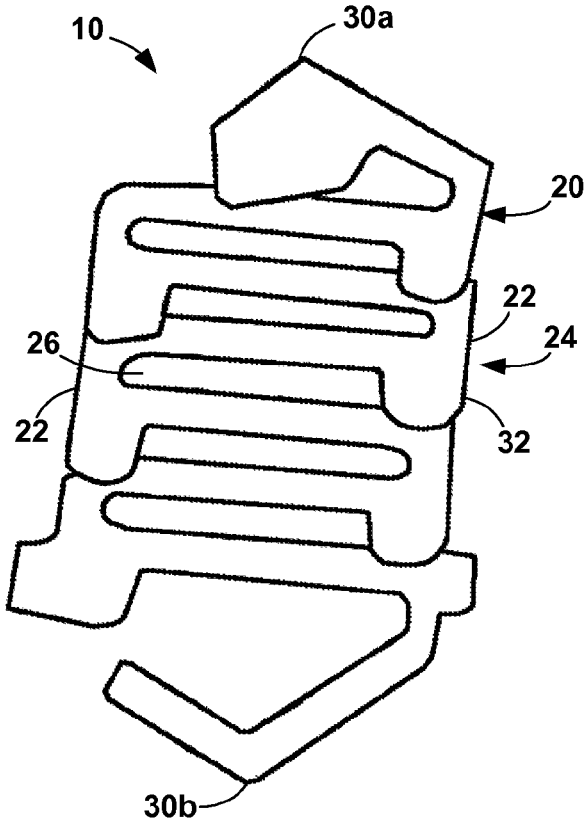
FIG. 9 is an front view of a configuration of the appendage embodiment of the contact of the present invention where all the appendages are on the same side of the contact.
Figure 10:
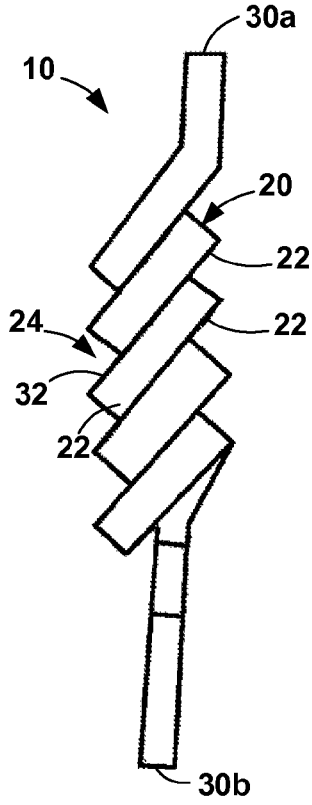
FIG. 10 is a side view of the contact of FIG. 9.
Figure 11:
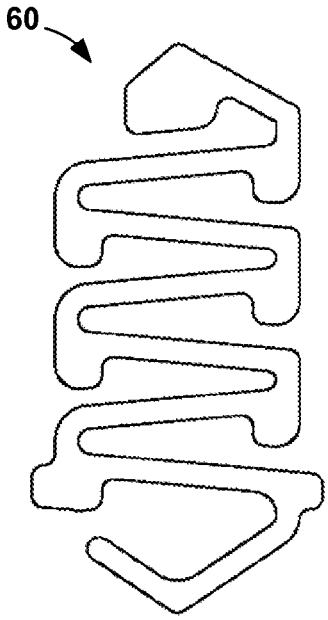
FIG. 11 is a front view of the contact of FIG. 9 after die cutting.
Figure 12:
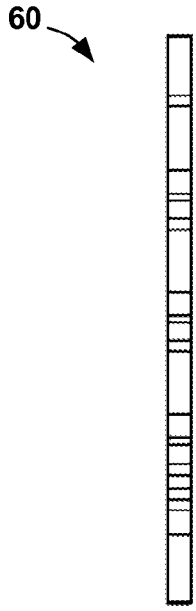
FIG. 12 is a side view of the die-cut contact of FIG. 9.

The appendages 24 may be formed such that they short on alternate, opposite sides of the convolutions 22, as in the configurations of FIGS. 2, 16, 19, and 24, or that they all short on one side of the convolutions 22, as in the configuration of FIG. 9. If the appendages 24 short on alternate, opposite sides of the convolutions 22, at least one of the contact points 30 may be forced through a twisting motion as it is compressed, inducing a twisting motion at the contact point 30 that can cut through potentially non-conductive oxides on the surface of the conduction point 6.

Figure 28:
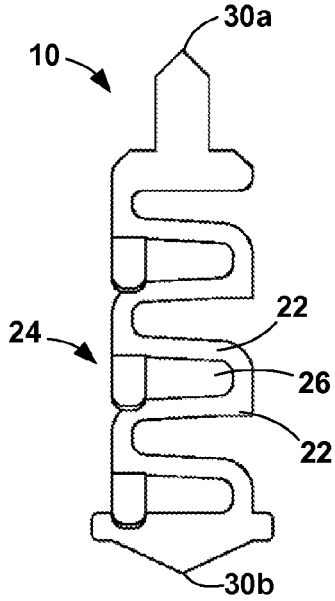
FIG. 28 is a front view of a configuration of the appendage embodiment the contact of the present invention where the appendages are on one side only.

The appendages 24 may be placed at any position along the convolution 22 but optimally, to eliminate any antenna affect of the convolution end, they should be placed at the end of the convolution 22. Optionally, there may be appendages 24 on only one side of the contact 10, for example, only along the left side of the contact 10, as in the configuration of FIG. 28.

Figure 2:
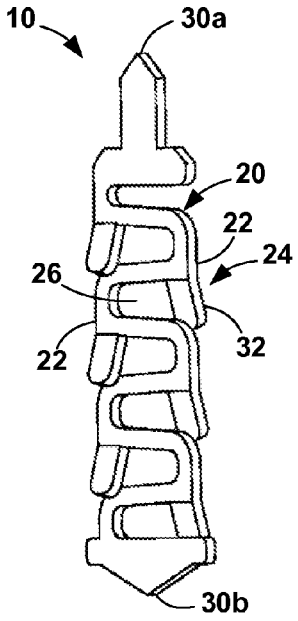
FIG. 2 is an isometric view of a configuration of the appendage embodiment of the contact of the present invention employing bent fingers.
Figure 13:
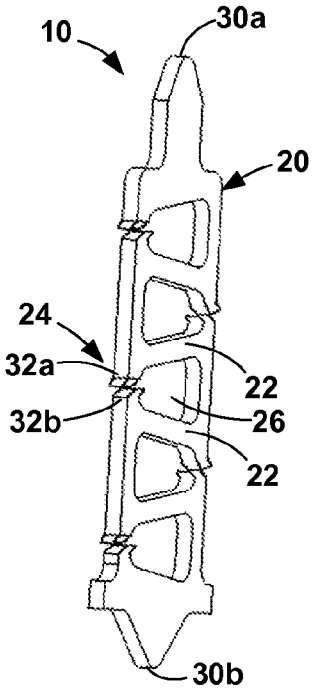
FIG. 13 is an isometric view of a configuration of the appendage embodiment of the contact of the present invention employing opposed fingers separated by bending the fingers.
Figure 14:
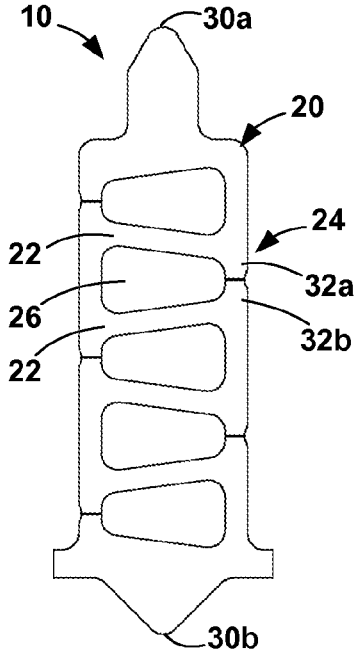
FIG. 14 is a front view of the contact of FIG. 13.
Figure 15:
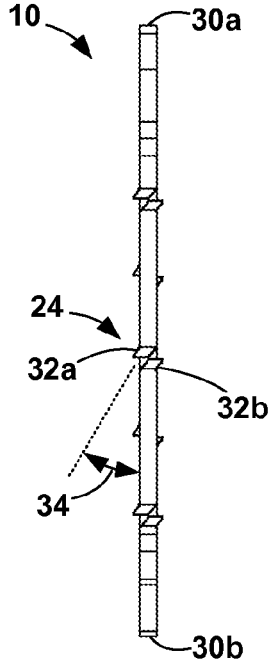
FIG. 15 is a side view of the contact of FIG. 13.
Figure 16:
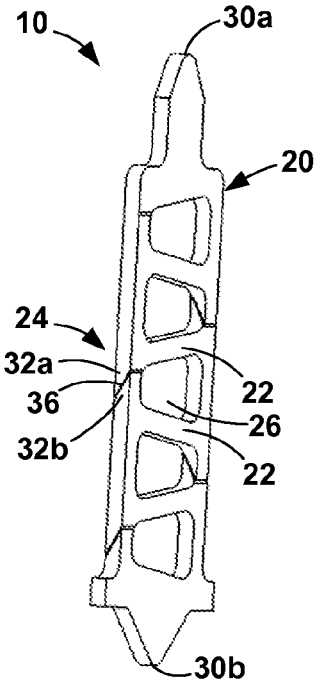
FIG. 16 is an isometric view of a configuration of the appendage embodiment of the contact of the present invention where separation in the opposed fingers is an angle cut.
Figure 17:
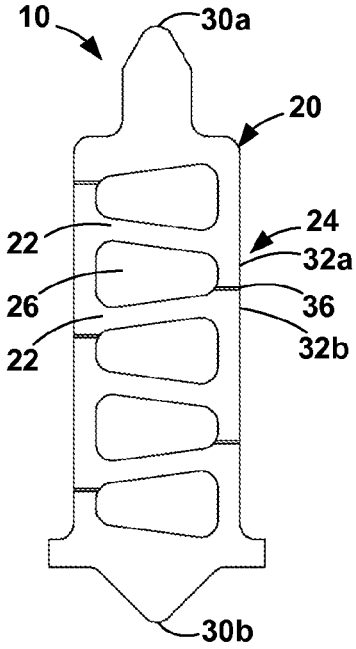
FIG. 17 is a front view of the contact of FIG. 16.
Figure 18:
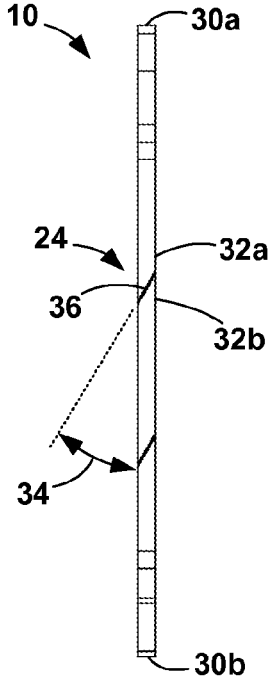
FIG. 18 is a side view of the contact of FIG. 16.
Figure 23:
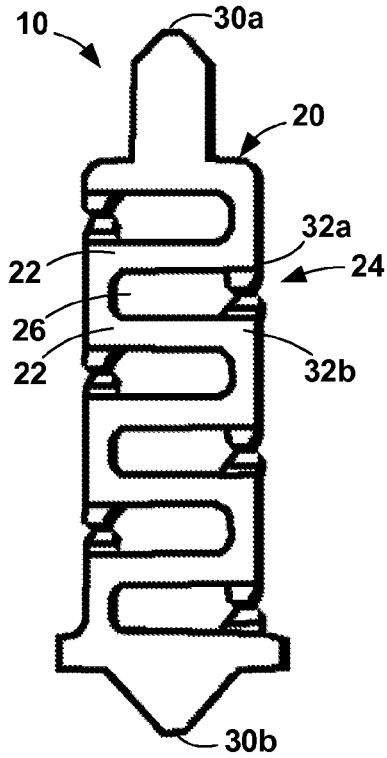
FIG. 23 is a front view of an alternate configuration of the contact of FIG. 19.

In some configurations, such as FIGS. 2, 9, and 13, the fingers 32 are at a skew angle 34 to the direction of compression 16. In other configurations, a surface on the appendage 24 or finger 32 is at a skew angle 34 to the direction of compression 16. For example, in the configuration of FIGS. 13-15 the fingers 32*a*, 32*b* are bent in the opposite direction to prevent them from binding on each other and directing them to one side or the other of each other during compression. In the configuration of FIGS. 16-18, the fingers 32*a*, 32*b* are separated by an angled slot 36 which prevents the fingers 32*a*, 32*b* from binding on each other and directs them to one side or the other of each other during compression. In the configuration of FIGS. 19-22 and the configuration of FIG. 23, the fingers 32*a*, 32*b* are beveled by peening or swaging the ends of the fingers 32*a*, 32*b*. The bevel 38 has a skew angle 34 to the direction of compression 16 that guides the fingers 32*a*, 32*b* away from each other during compression and prevents them from binding on each other during compression. In the configuration of FIGS. 24-27, the appendages 24 are not distinct from the rest of the convolution 22; the appendages 24 are beveled edges 66 of the convolution 22. The beveled edges 66 are machined or peened in a manner similar to the configuration of FIGS. 19-22 so that the they are offset from each other. This feature guides the adjacent convolutions 22 away from each other during compression and prevents the adjacent convolutions 22 from binding on each other during compression.

The magnitude of the skew angle 34 depends on the particular application and the compliance forces required for that application. The smaller the skew angle 34, the smaller the force necessary to compress the contact 10, which means that the contact 10 will provide a smaller force against the conduction points 6. The magnitude of the angle 34 does have limits. As the skew angle 34 approaches 90°, that is, perpendicular to the direction of compression 16, the contact 10 will not compress further once the appendage 24 has come into contact with the adjacent convolution 22. As the angle approaches 0°, that is, parallel to the direction of compression 16, the contact pressure between an appendage 24 and the adjacent convolution 22 is small and may not maintain the electrical short. Consequently, steps should be taken to make sure that contact is maintained.

Figure 29:
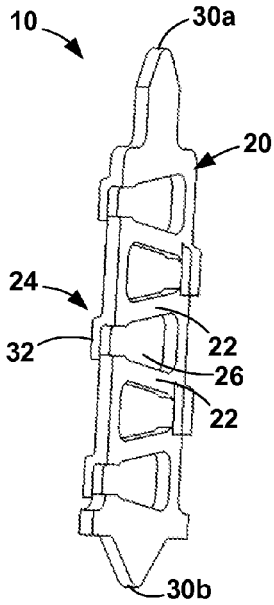
FIG. 29 is an isometric view of a configuration of the appendage embodiment of the contact of the present invention where the appendages are fingers parallel to the direction of compression.
Figure 30:
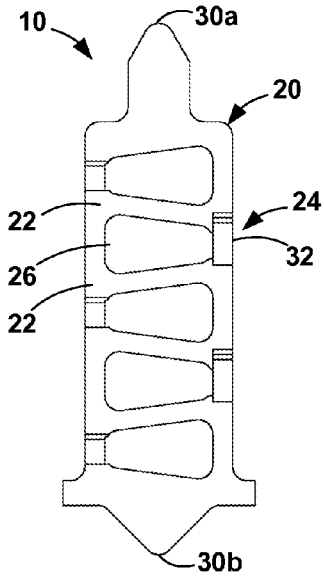
FIG. 30 is a front view of the contact of FIG. 29.
Figure 31:
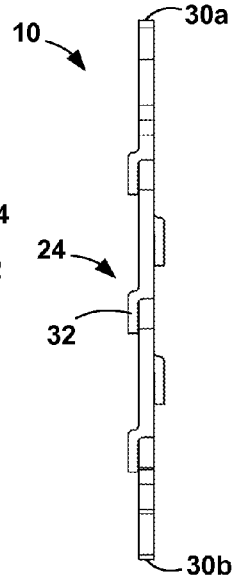
FIG. 31 is a side view of the contact of FIG. 29.
Figure 32:
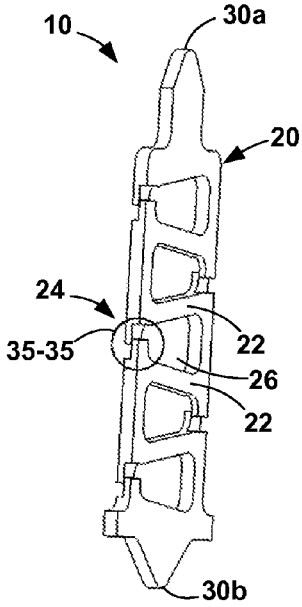
FIG. 32 is an isometric view of a configuration of the appendage embodiment of the contact of the present invention where the appendages are opposed fingers parallel to the direction of compression.
Figure 33:
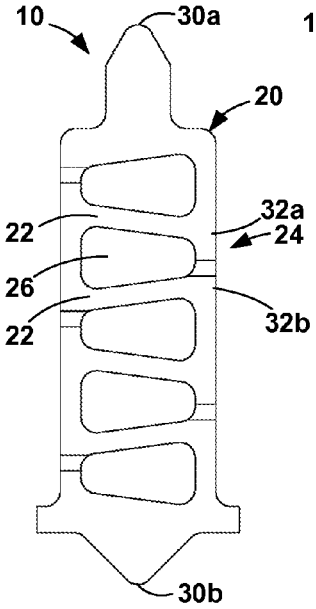
FIG. 33 is a front view of the contact of FIG. 32.
Figure 34:
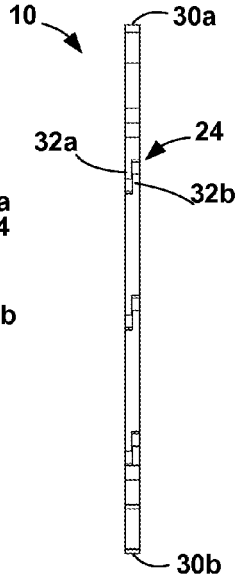
FIG. 34 is a side view of the contact of FIG. 32.
Figure 35:
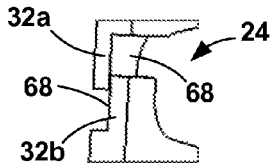
FIG. 35 is a detail view of area 35-35 of the contact of FIG. 32.
Figure 36:
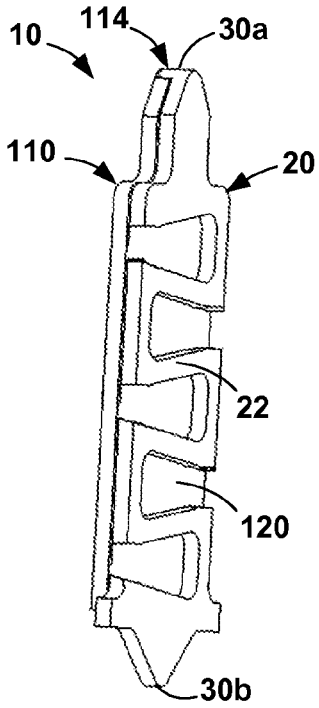
FIG. 36 is an isometric view of a configuration of the shunt embodiment of the contact of the present invention.
Figure 37:
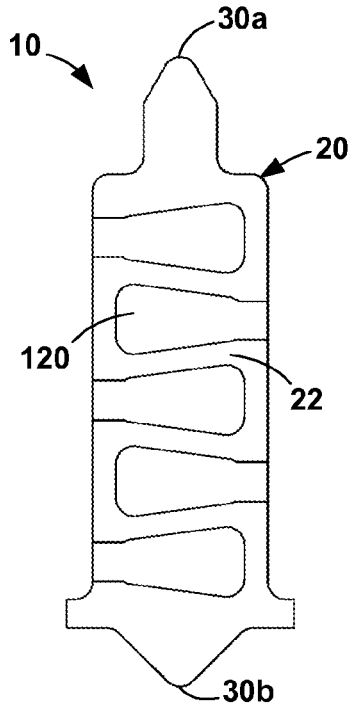
FIG. 37 is a front view of the contact of FIG. 36.
Figure 38:
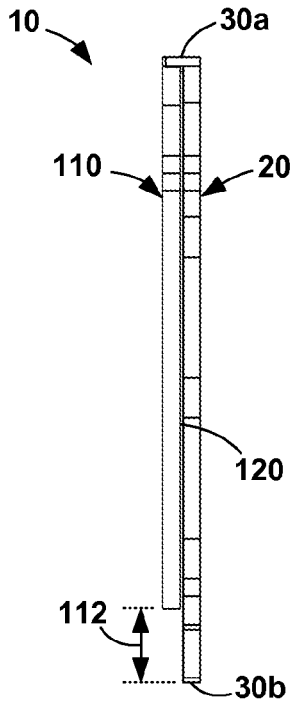
FIG. 38 is a side view of the contact of FIG. 36.
Figure 39:
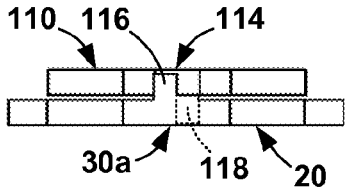
FIG. 39 is a top view of the contact of FIG. 36.
Figure 40:
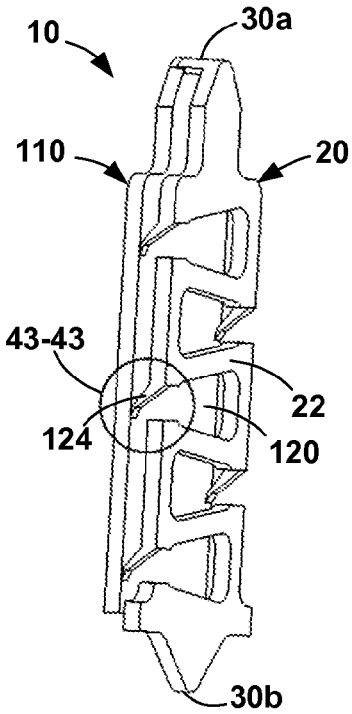
FIG. 40 is an isometric view of a configuration of the shunt embodiment of the contact of the present invention employing convolution wipes.
Figure 41:
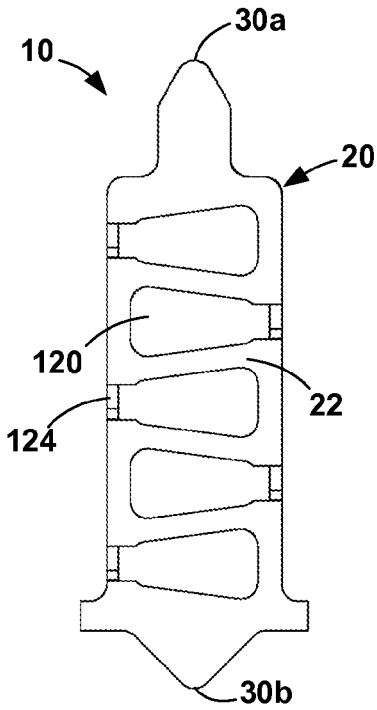
FIG. 41 is a front view of the contact of FIG. 40.
Figure 42:
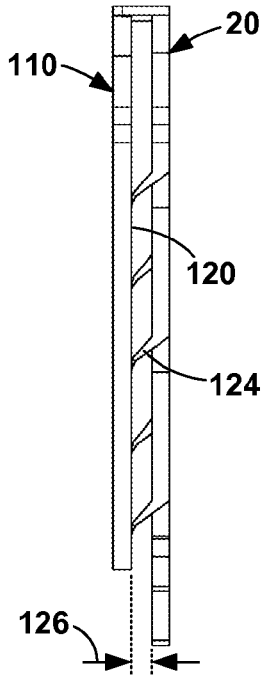
FIG. 42 is a side view of the contact of FIG. 40.
Figure 43:
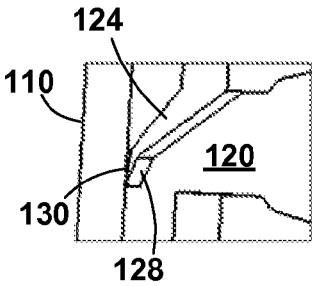
FIG. 43 is a detail view of area 43-43 of the contact of FIG. 40.

As the skew angle 34 approaches 0°, the finger(s) 32, 32*a*, 32*b* must be offset from each other or the adjacent convolution 22 so that they do not bind on each other during compression. FIGS. 29-35 show two such configurations. In the configuration of FIGS. 29-31, the finger 32 is bent outwardly and then downwardly to overlap the adjacent convolution 22. The finger 32 slides against the adjacent convolution 22 in order to maintain the electrical short during compression. In the configuration of FIGS. 32-35, the fingers 32*a*, 32*b* are machined so that each is approximately half the thickness of the contact 10. The vertical faces 68 slide against each other during compression to provide the electrical short between convolutions 22. In both configurations, the finger(s) 32, 32*a*, 32*b* can be provided with a small angle so that shorting contact is maintained.

In addition to the skew angle 34, the force versus deflection curve of the contact 10 is determined by other convolution parameters, such as the volume of the material used in manufacturing the contact, e.g., the material cross-sectional dimension, the convolution length, and the number of convolutions, as well as the cross-sectional shape and material. The cross-sectional shape of the material can be round or any other shape including square, triangular, elliptical, rectangular, or star. The material may be hollow. The present invention also contemplates that the cross-sectional dimension does not have to be uniform over the length of the material. Consequently, the shortest electrical path possible is created, resulting in a lower inductance connection. However, for cost and other reasons, material with round sides is not necessarily preferred over square and rectangular material.

The appendages 24 that guide the convolutions 22 away from each other also help ensure an electrical short during compression since the quiescent state of the convolutions 22 are aligned and the further the contact 10 is compressed, the more the convolutions 22 are forced out of line with each other, thereby increasing the contact force for the electrical short between the appendage 24 and adjacent convolution 22.

For some of the contact configurations, the appendages 24 are always shorting adjacent convolutions 22, including in the quiescent state when there is no compression. For example, each finger 32 of the configuration of FIG. 2 shorts to the adjacent convolution 22 in the quiescent state. As the contact 10 is compressed, the finger 32 slides along the edge of the adjacent convolution, maintaining the short throughout the compression range. In another example, the opposed fingers 32*a*, 32*b* of the configuration of FIG. 16 short to each other either in the quiescent state or with a slight application of compression. As the contact 10 is compressed, the opposed fingers 32*a*, 32*b* slide along each other, maintaining the short throughout the compression range. Consequently, for these configurations, the convolutions 22 are electrically shorted throughout nearly the entire compression range of the contact 10.

Figure 24:
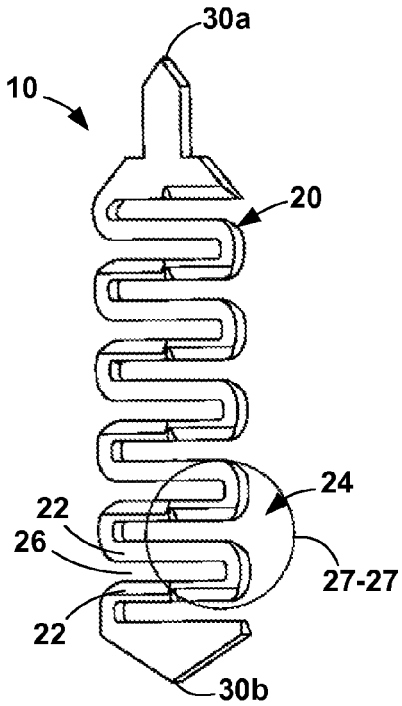
FIG. 24 is an isometric view of a configuration of the appendage embodiment of the contact of the present invention where the appendages are bevels formed into the edges of the convolutions.
Figure 25:
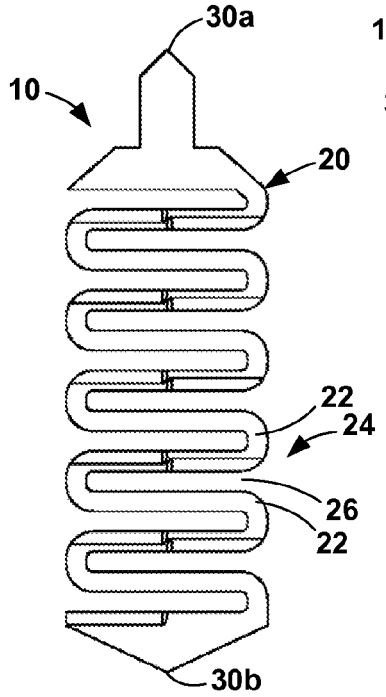
FIG. 25 is a front view of the contact of FIG. 24.
Figure 26:
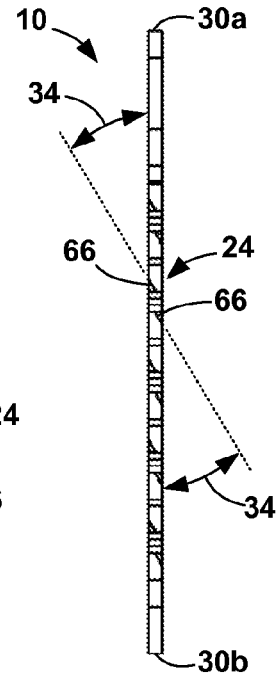
FIG. 26 is a side view of the contact of FIG. 24.
Figure 27:
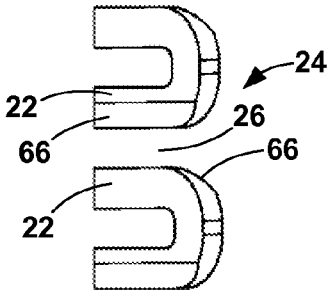
FIG. 27 is a detail view of area 27-27 of the contact of FIG. 24.

For other configurations, notably that of FIG. 24, the appendage 24 is not shorted to the adjacent convolution 22 until the contact 10 has been compressed some distance. From this point, the convolutions 22 are electrically shorted throughout the remainder of the compression range of the contact 10.

Thus, in all of the contact configurations of the first embodiment of the present invention, adjacent convolutions 22 are shorted throughout a significant portion of the compression range. Consequently, electrically, the contact 10 can be extremely short with very low electrical parasitics.

In the second embodiment of the contact 10 of the present invention, shown in FIGS. 36-49, the contact 10 has a shunt 110 that is generally parallel to the spring 20 and that spans the convolutions 22 longitudinally. The shunt 110 is attached at or near one of the contact points 30*a* and spans most or all of the convolutions, leaving a length 112 that the shunt 110 does not span. The length 112 leaves space for the shunt 110 so that it does not extend all the way to the other contact point 30*b* at full compression, thereby allowing the contact 10 to compress fully.

As indicated above, the shunt 110 is attached at or near one of the contact points 30*a*, as at 114. The present invention contemplates any manner of attachment. In one manner, the contact 10 is stamped as a single unit and bent 180° at the contact point 30*a* so that the shunt 110 and spring 20 are parallel. In another, shown in FIG. 39, the shunt 110 and spring 20 are stamped as separate components with abutting, interlocking projections 116, 118 that are later attached together. The attachment can take any form suitable, including soldering, brazing welding, adhesive, etc.

In most of the configurations, the shunt 110 electrically shorts each convolution 22 to the adjacent convolution 22. In the configuration of FIGS. 36-39, the shunt 110 is parallel to and abutting the spring 20. When the contact 10 is compressed, in order to maintain the electrical short, the convolutions 22 wipe on the abutting surface 120 of the shunt 110.

Figure 44:
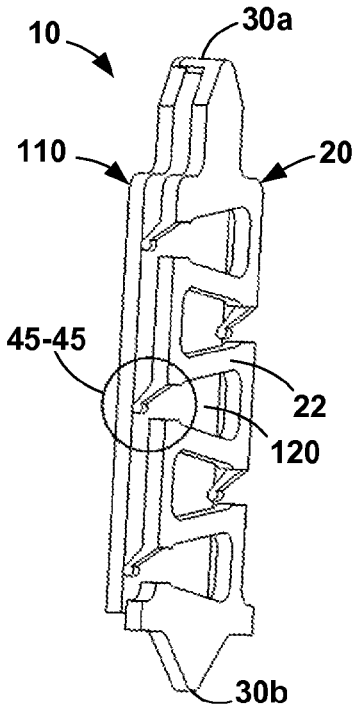
FIG. 44 is an isometric view of a configuration of the shunt embodiment of the contact of the present invention employing convolution wipes.
Figure 45:
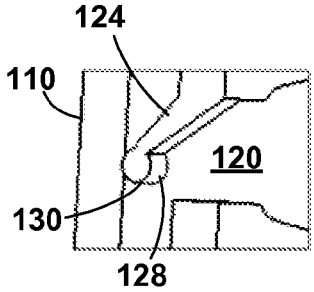
FIG. 45 is a detail view of area 45-45 of the contact of FIG. 44.

In the configurations of FIGS. 40-45, each convolution 22 is electrically shorted to the shunt 110 by a wiper 124. The wiper 124 extends away from the convolution 22 toward the shunt 110, which is not abutting but is spaced from the spring 20, as at 126. The end 128 of the wiper 124 maintains contact with the shunt 110 through the full compression range. In the configuration of FIGS. 40-43, the end 128 of the wiper 124 is a flat surface 130. In the configuration of FIGS. 44 and 45, the end of the wiper 128 is a cylindrical surface 132. Alternatively, the wiper 124 can be replaced by a dimple extending from the spring 20.

Figure 46:
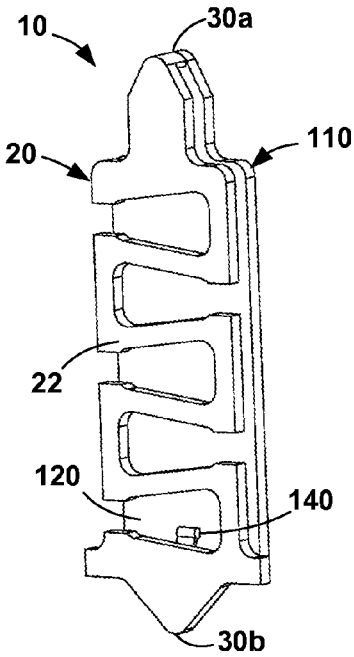
FIG. 46 is an isometric view of a configuration of the shunt embodiment of the contact of the present invention employing a shunt end wipe.
Figure 47:
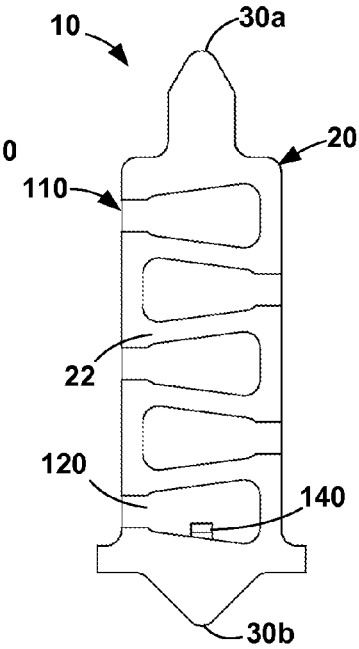
FIG. 47 is a front view of the contact of FIG. 46.
Figure 48:
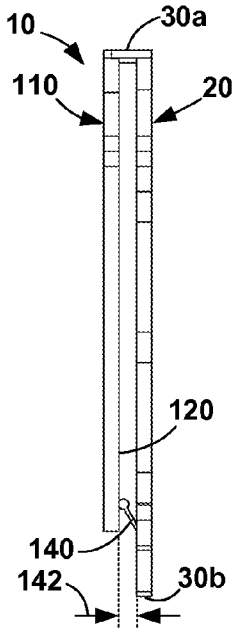
FIG. 48 is a side view of the contact of FIG. 46.
Figure 49:
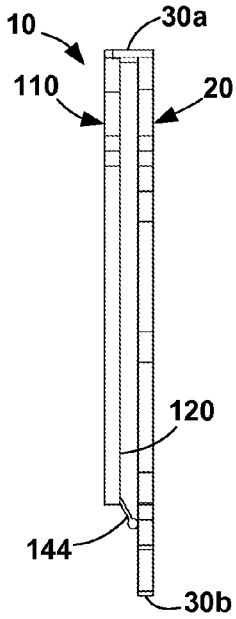
FIG. 49 is an side view of a configuration of the shunt embodiment of the contact of the present invention employing a shunt end wipe.

In the configurations of FIGS. 46-49, the shunt 110 electrically shorts the two contact points 30*a*, 30*b* directly, bypassing the convolutions 22. In the configuration of FIGS. 46-48, a wiper 140 extends away from the spring 20 to the shunt 110, which is not abutting but is spaced from the spring 20, as at 142. The end 144 of the wiper 140 maintains contact with the shunt 120 through the full compression range. In the configuration of FIG. 49, a wiper 144 extends away from the shunt 110 to the spring 20 and maintains contact with the shunt 120 through the full compression range.

Figure 50:
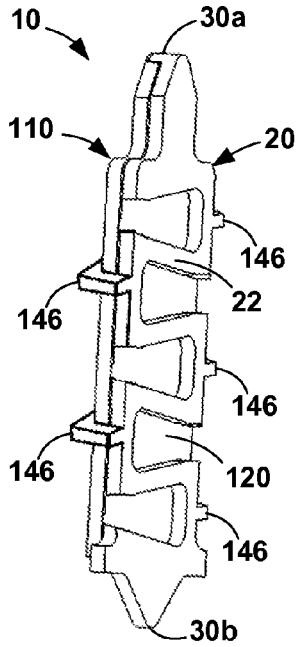
FIG. 50 is an isometric view of a configuration of the shunt embodiment of the contact of the present invention employing a method of maintaining shunt/spring contact.
Figure 51:
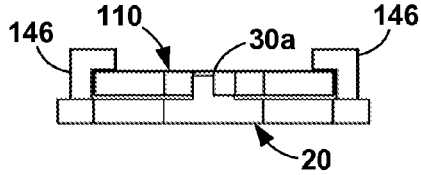
FIG. 51 is a top view of the contact of FIG. 50.

Preferably, a force pushes or holds the shunt 110 against the spring 20 to make sure that contact between the shunt 110 and the spring 20 is maintained. One method is described below relative to the aperture 42 in which the contact 10 resides in the dielectric panel 40. In another, one or more hooks 146 extends from the spring 20 and are bent around the shunt 110, as shown in FIGS. 50 and 51.

Figure 3:
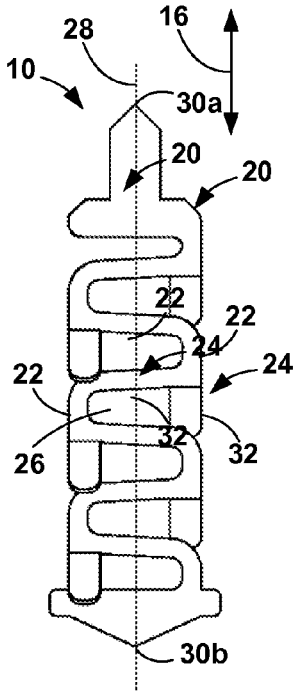
FIG. 3 is a front view of the contact of FIG. 2.
Figure 4:
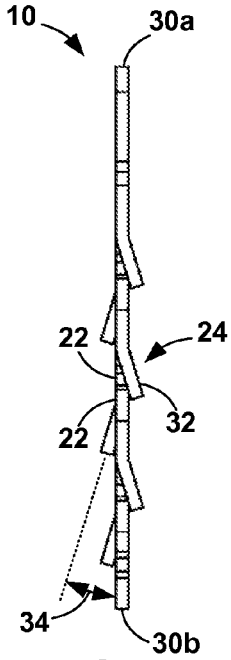
FIG. 4 is a side view of the contact of FIG. 2.
Figure 5:
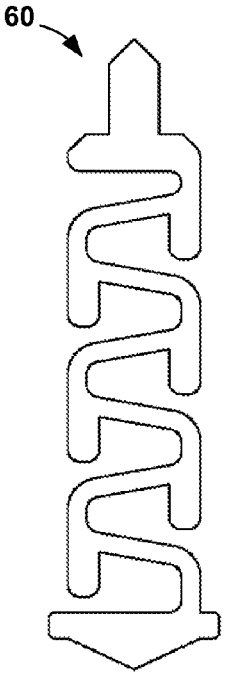
FIG. 5 is a front view of the contact of FIG. 2 after die cutting.
Figure 6:
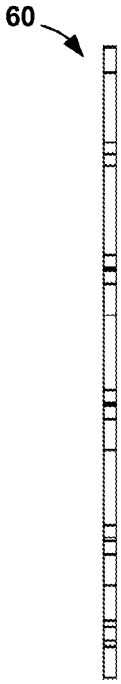
FIG. 6 is a side view of the die cut contact of FIG. 5.
Figure 7:
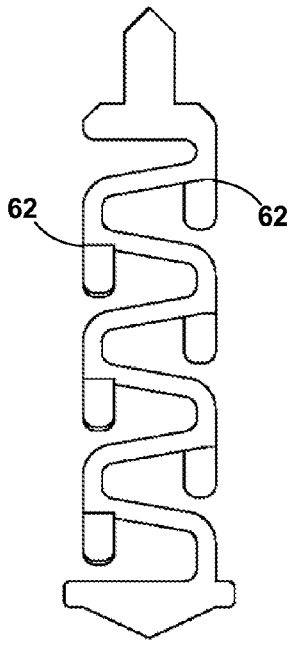
FIG. 7 is a front view of the die cut contact of FIG. 5 after bending to produce shorting appendages.
Figure 8:
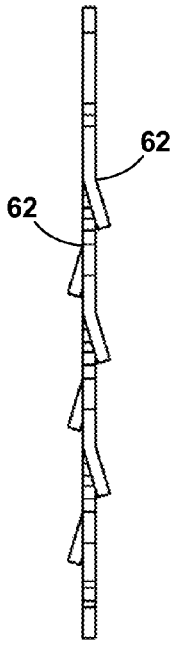
FIG. 8 is a side view of the bent contact of FIG. 7.

The contact 10 is produced by stamping or otherwise forming a length or sheet of electrically conductive material. FIGS. 5, 6, 11, 12, 14, and 15 show the output 60 of the stamping process for these three contact configurations. The stamping 60 is bent, as at 62, and/or machined as required to produce the appendages 24. FIGS. 7 and 8 show the result after the appendages 24 are formed by bending, but before the convolutions 22 are compressed to the final shape, as shown in FIGS. 2-4.

Figure 52:
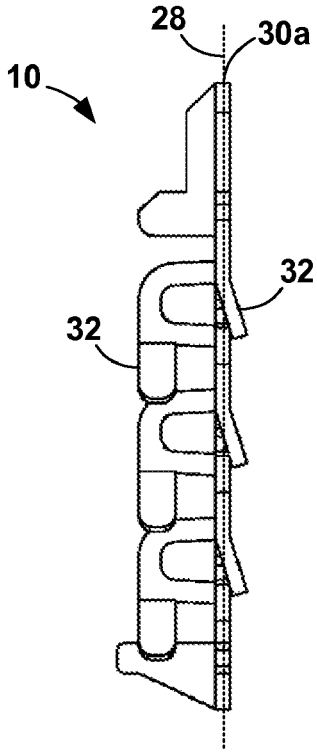
FIG. 52 is a front view of a configuration of the appendage embodiment of the contact of the present invention bent at 90°.
Figure 53:
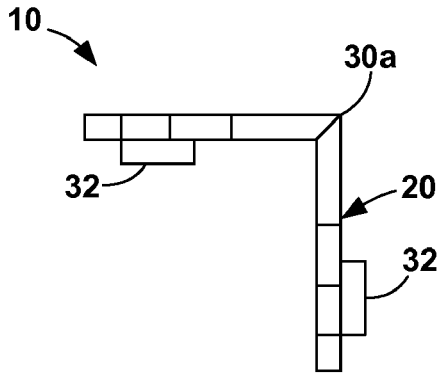
FIG. 53 is a top view of the contact of FIG. 52.
Figure 54:
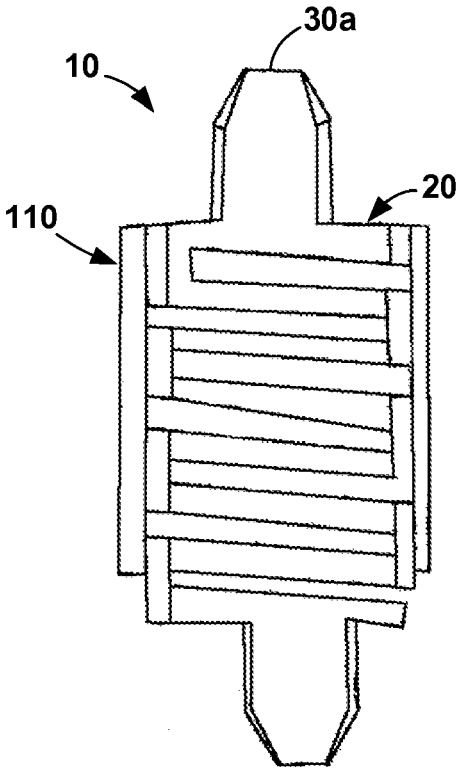
FIG. 54 is a front view of a configuration of the shunt embodiment of the contact of the present invention curved over 90°.
Figure 55:
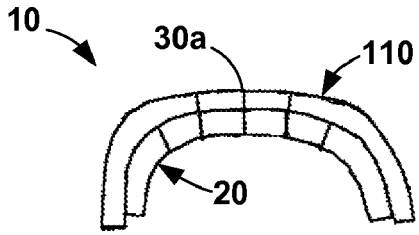
FIG. 55 is a top view of the contact of FIG. 54.
Figure 56:
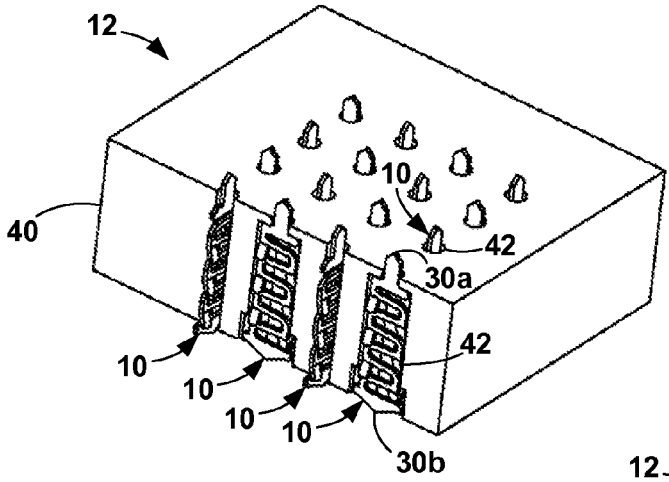
FIG. 56 is an isometric, cutaway view of an assembly of the present invention employing contacts of FIG. 2 installed in alternating orthogonal orientations.
Figure 57:
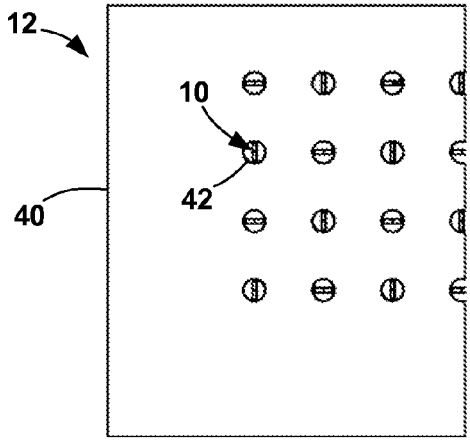
FIG. 57 is a top view of a section of the assembly of FIG. 56.

The present specification describes and shows the contact 10 as flat when viewed from a contact point 30. However, the present invention contemplates that the contact 10 can have other shapes. For example, FIGS. 52 and 53 show a contact 10 of the appendage embodiment of FIG. 2 that is bent at a 90° on the longitudinal axis 28. FIGS. 54 and 55 show a contact 10 of the shunt embodiment of FIG. 36 that is bent in a semicircular curve, resulting in a contact 10 that is semicylindrical. These are merely examples and other angles and curves can be implemented.

The material can be any electrically conductive material which has inherent elastic properties, for example, stainless steel, beryllium copper, copper, brass, nickel-chromium alloy, and palladium-rare metal alloys, such as PALINEY 7®, an alloy of 35% palladium, 30% silver, 14% copper, 10% gold, 10% platinum, and 1% zinc. All of these materials can be used in varying degrees of temper from annealed to fully hardened.

The contact 10 is used in an assembly 12 that provides temporary electrical connections to conduction points 6 between the two electrical devices 2, 4. In general, the contact 10 is placed within a through aperture 42 in a dielectric panel 40. The aperture 42 has a cavity 52 with openings 44*a*, 44*b* at both ends. The bulk of the contact 10 resides in the cavity 52 and the contact points 30 protrude through the openings 44*a*, 44*b*.

Figure 60:
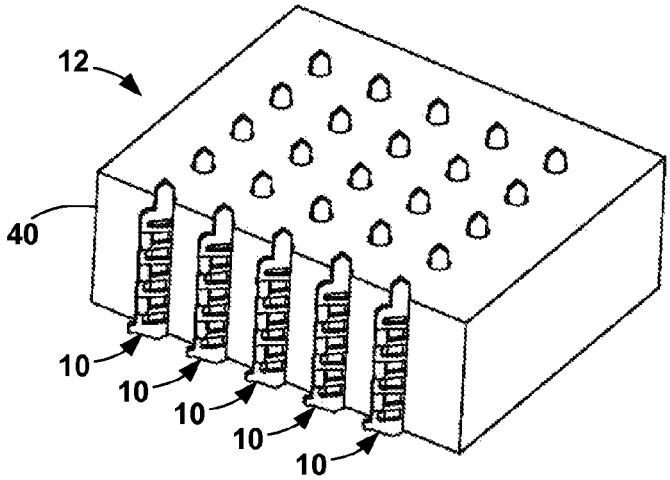
FIG. 60 is an isometric, cutaway view of an assembly of the present invention employing contacts of FIG. 2 installed parallel to each other.
Figure 61:
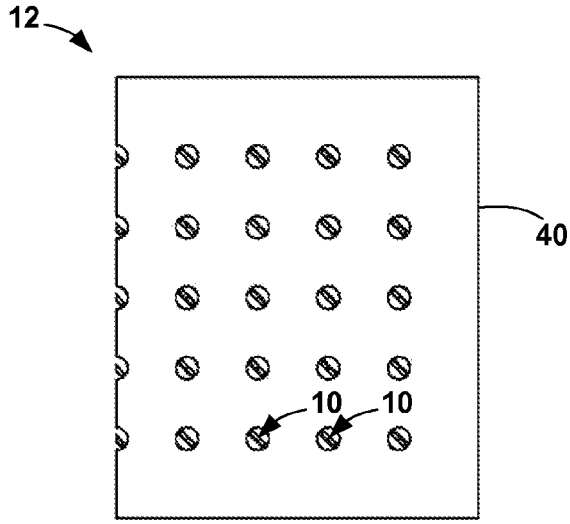
FIG. 61 is a top view of a section of the assembly of FIG. 61.

The assembly 12 of FIGS. 56-59 shows a configuration where adjacent contacts 10 are oriented at right angles to each other. The assembly 12 of FIGS. 60 and 61 show a configuration where all of the contacts 10 are oriented in the same direction. The present invention contemplates that the contacts 10 may be at any orientation relative to each other. Changing the orientation of the contacts 10 can lower the electrical parasitic values of the connection.

When a compression force 14 is applied in the compression direction 16 to the contact points 30 protruding through the openings of the dielectric panel 40, the aperture 42 maintains the position of the contact 10 as the compression force 14 is applied. For the appendage embodiments of the contact, the contact 10 may float within the cavity 52, being retained by the openings 44*a*, 44*b* or other mechanism. For the shunt embodiments of the contact 10, the cavity 52 may provides a mechanism to press the spring 20 and shunt 110 together to ensure contact between them. This could include a protruding feature or features on the wall of the cavity 52. The cavity 52 may also aid in maintaining the integrity of the contact 10 by preventing the convolutions 22 from separating under compression.

The contact 10 can be made extremely small by employing extremely thin material and forming apertures 42 in the dielectric panel 40 for connecting electrical devices 2, 4 with pitches smaller than 0.5 mm.

Figure 58:
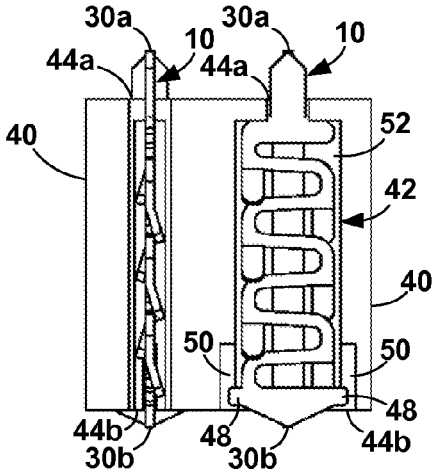
FIG. 58 is an enlarged, cross-sectional, side view of a section of the assembly of FIG. 56.
Figure 59:
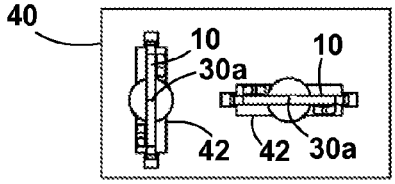
FIG. 59 is an enlarged, bottom view of a section of the assembly of FIG. 56.
Figure 62:
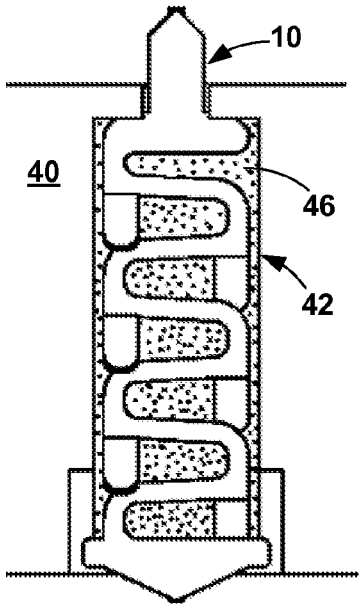
FIG. 62 is an enlarged, cross-sectional, side view of a section of the assembly of FIG. 56 showing the aperture filled with an elastomer.

Optionally, the space within the contact apertures 42 remaining after the contact 10 is installed is filled with a compliant, electrically conductive elastomer 46, as shown in FIG. 62. The elastomer 46 can perform three functions. It adds to the resiliency of the contact 10, meaning that the contact 10 can tolerate more operational cycles than without the elastomer 46. The elastomer 46 can aid in electrically shorting the convolutions 22, thus potentially minimizing the electrical parasitic values of the contact 10. The elastomer 46 can also act as a retention method for holding the contact 10 in the aperture The contact 10 is secured in the aperture 42 by any adequate means. In one example, as previously mentioned, the elastomer 46 may aid in retention. In another example, the contact 10 may have bosses which attach the contact 10 to a bandoleer (not shown) until installation. Once the contact 10 is sheared from bandoleer, the remaining stub 48 can be used for retention. As shown in FIG. 58, the stub 48 can slide into a slot 50 that is longitudinal to the contact 10 such that the contact 10 can float within the aperture 42, thus ensuring the same contact force on the electrical devices 2, 4. The ends of the slot 50 may be swaged over, as at 52, so the contact 10 is retained within the aperture 42. Alternatively, the slot 50 may be narrower than the stub 48 and the stub 48 is pressed into the slot 50 for a friction or interference fit. In this case, the bottom contact point is not compliant, that is, it will not move relative to the dielectric panel 40.

Thus it has been shown and described a compliant electrical contact and assembly which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A compliant electrical contact adapted to be compressed through a compression range, said contact comprising:

(a) a spring comprised of an electrically conductive, inherently elastic material, and having a longitudinal axis, a plurality of convolutions, and two ends;

(b) a contact point at each of said spring ends;

(c) a plurality of said convolutions including an appendage that shorts to an adjacent convolution over a significant portion of said compression range when said contact is compressed generally parallel to said longitudinal axis.

2. The compliant electrical contact of claim 1 wherein said appendage is a finger extending toward said adjacent convolution at an angle to said axis, said finger shorting to said adjacent convolution throughout a significant portion of said compression range.

3. The compliant electrical contact of claim 2 wherein said angle is between approximately 0° and approximately 85° from said axis.

4. The compliant electrical contact of claim 1 wherein said appendage is a pair of opposed fingers extending toward each other from adjacent convolutions, said fingers contacting each at an angle to said axis and shorting to each other throughout a significant portion of said compression range.

5. The compliant electrical contact of claim 4 wherein said angle is between approximately 0° and approximately 85° from said axis.

6. The compliant electrical contact of claim 1 wherein said appendage is a pair of opposed beveled surfaces on adjacent convolutions, said beveled surfaces being at an angle to said axis, said beveled surfaces shorting to each other throughout a significant portion of said compression range.

7. The compliant electrical contact of claim 6 wherein said angle is between approximately 0° and approximately 85° from said axis.

8. The compliant electrical contact of claim 1 wherein said contact is flat.

9. A compliant electrical contact assembly adapted to provide a temporary electrical connection between a conduction point of a first electrical device and a conduction point of a second electrical device, said electrical devices being compressed together by a compression force in a direction of compression with said assembly therebetween, said assembly comprising:

(a) at least one compliant electrical contact, said contact including a spring comprised of an electrically conductive, inherently elastic material, and including a plurality of convolutions, two ends, a contact point at each of said spring ends, and a plurality of said convolutions including an appendage that shorts to an adjacent convolution over a significant portion of said compression range when said contact is compressed in said direction of compression; and (b) a dielectric panel having a through aperture for each of said at least one electrical contact, said contact being captured in said aperture such that said contact points extend through opposed openings of said aperture.

10. The compliant electrical contact assembly of claim 9 wherein said appendage is a finger extending toward said adjacent convolution at an angle to said direction of compression, said finger shorting to said adjacent convolution throughout a significant portion of said compression range.

11. The compliant electrical contact assembly of claim 10 wherein said angle is between approximately 0° and approximately 85° from said axis.

12. The compliant electrical contact assembly of claim 9 wherein said appendage is a pair of opposed fingers extending toward each other from adjacent convolutions, said fingers contacting each at an angle to said direction of compression and shorting to each other throughout a significant portion of said compression range.

13. The compliant electrical contact assembly of claim 12 wherein said angle is between approximately 0° and approximately 85° from said axis.

14. The compliant electrical contact assembly of claim 9 wherein said appendage is a pair of opposed beveled surfaces on adjacent convolutions, said beveled surfaces being at an angle to said direction of compression, said beveled surfaces shorting to each other throughout a significant portion of said compression range.

15. The compliant electrical contact assembly of claim 14 wherein said angle is between approximately 0° and approximately 85° from said axis.

16. The compliant electrical contact assembly of claim 9 wherein said aperture is filled with a compliant, conductive elastomer in addition to said contact.

17. The compliant electrical contact assembly of claim 9 wherein said at least one contact is a plurality of contacts and adjacent ones of said contacts are oriented perpendicular to each other.

18. The compliant electrical contact assembly of claim 9 wherein said at least one contact is a plurality of contacts and said contacts are oriented parallel to each other.

19. The compliant electrical contact assembly of claim 9 wherein said contact is flat.

* * * * *